US005505273A

United States Patent [19]

Azar et al.

[11] Patent Number: 5,505,273

[45] Date of Patent: Apr. 9, 1996

[54] COMPOUND DIAMOND CUTTER

[75] Inventors: Michael G. Azar, Houston, Tex.; Simon N. Willis, Leicester, United Kingdom

[73] Assignee: Smith International, Inc., Houston, Tex.

[21] Appl. No.: 185,645

[22] Filed: Jan. 24, 1994

[51] Int. Cl.[6] ..... E21B 10/52

[52] U.S. Cl. ..... 175/428; 175/432

[58] Field of Search ..... 175/420.1, 420.2, 175/428, 432, 434

[56] References Cited

U.S. PATENT DOCUMENTS

| | | | |
|---|---|---|---|
| 4,718,505 | 1/1988 | Fuller | 175/329 |
| 4,804,049 | 2/1989 | Barr | 175/428 |
| 4,832,892 | 4/1989 | Fuller | 175/329 |
| 4,889,017 | 12/1989 | Fuller et al. | 175/329 X |
| 4,991,670 | 2/1991 | Fuller et al. | 172/329 |
| 5,007,493 | 4/1991 | Coolidge et al. | 175/432 |
| 5,244,039 | 9/1993 | Newton et al. | 175/431 |

*Primary Examiner*—William P. Neuder

[57] ABSTRACT

A diamond drag bit is disclosed that utilizes stud type PDC cutters that have dome shaped polycrystalline diamond depth of penetration limiters fused to the tungsten carbide surface trailing the PDC compact disc. This cutter penetration limiting diamond dome surface acts as an impact or shock absorber to minimize the impact damage to the PDC cutter when drilling laminated hard and soft rock formations.

17 Claims, 2 Drawing Sheets

COMPOUND DIAMOND CUTTER

BACKGROUND OF THE INVENTION

I. FIELD OF THE INVENTION

The present invention relates to rotary diamond drag bits for use in drilling holes in subsurface formations.

More specifically, the present invention relates to rotary diamond drag bits having a multiplicity of compound polycrystalline diamond compact (PDC) cutting elements strategically mounted on the cutting face of the drag bit.

The compound PDC cutter has a dome shaped PDC trailing surface that acts as a penetration limiter for the leading rock shearing PDC cutter disc associated therewith. The domed trailing surface limits impact damage to the shear cutter disc when drilling hard laminar or non-homogeneous rock formations.

II. DESCRIPTION OF THE PRIOR ART

There are a number of diamond drag bit patents that bear a slight semblance to the present invention, but all are intended to be backup systems for the primary PDC cutters when the cutters become badly worn or broken.

U.S. Pat. No. 4,823,892 teaches embedding small natural diamond or other ultra hard particles in the PDC cutters tungsten carbide surface trailing the primary PDC cutter disc. This concept is designed to be a backup system to abrade away the rock formation after the primary PDC cutter disc is badly worn or broken. Although this does allow some bits to continue drilling, the rate of penetration is extremely slow because the imbedded diamond particles are not aggressive enough to remove nearly as much rock formation per bit revolution as a sharp PDC cutter disc. The embedded diamonds trailing the PDC cutter are very brittle and break under relatively low impact loads, therefore they don't serve as good shock absorbers to prevent PDC cutter breakage.

The present invention overcomes the shortcomings and disadvantages of the foregoing prior art by providing a very strong partial dome shaped polycrystalline diamond layer chemically and metallurgically bonded to the tungsten carbide stud immediately behind the leading PDC cutter disc. This polycrystalline diamond partial dome functions as a depth of penetration limiter and hence a shock absorber for the PDC cutter to minimize cutter damage while drilling. The smooth diamond surface having an extremely low coefficient of friction generates a very small amount of heat while rubbing on the rock formation while drilling. Therefore, heat deterioration of the diamond cutter or dome is of no consequence.

SUMMARY OF THE INVENTION

It is the object of the present invention to provide a diamond drag bit having a superior means to prevent PDC cutter breakage due to insert impact loads encountered while drilling a borehole.

More particularly, it is an object of this invention to provide a diamond drag bit having a shock absorber for each PDC cutter in the form of a partial dome shaped polycrystalline diamond layer bonded to the tungsten carbide stud or post immediately behind or trailing the PDC cutter disc attached thereto.

The diamond drag type drilling bit of the present invention consists of a bit body that forms a first threaded pin end and a second cutting end. The first pin end is opened to a source of drilling fluid that is transmitted through an attached drillstring. The pin end communicates with a fluid chamber that is formed by the bit body. A plurality of essentially radial raised lands or blades are formed by the second cutting end of the bit, thereby forming fluid channels therebetween. A multiplicity of PDC cutting elements are strategically positioned and fixedly attached to the raised lands or blades. One or more ports or nozzles are formed in the second cutting end of the bit. The ports communicate with a fluid chamber formed within the bit body. Drilling fluid or mud exits the nozzles into the fluid channels formed by the blades to cool and clean the PDC cutters during the drilling operation.

A diamond drag bit having a multiplicity of stud type diamond inserts or cutters strategically positioned on a cutting face formed by a body of said drag bit is disclosed.

The inserts consisting of a cylindrical stud body forming a first base end and a second cutting end. The cutting end of the body consists of a substantially spherical dome surface. The dome surface further forms a relatively flat surface that is positioned below an apex of the dome. The flat surface is skewed from an axis of the stud body.

A polycrystalline diamond compact is connected to the flat surface. A cutting edge formed by the compact nearest the apex of the dome is positioned below the apex such that the dome limits penetration of the cutting edge as the drag bit works in an earthen formation.

The aforementioned partial dome shaped PDC shock absorber positioned as part of the tungsten carbide stud or post behind the PDC cutter disc may be formed first as a full PDC dome insert as described in U.S. Pat. No. 4,604,106 and 4,811,801, both of which are assigned to the same assignee as the present invention and are incorporated herein as reference. A back angled portion of the dome shaped PDC insert is subsequently removed by, for example, EDM to form a rearwardly angled flat plane to which a PDC compact cutter disc is brazed to form a complete PDC cutter/PDC shock absorber unit.

An advantage then over the prior art is the means by which a PDC cutter penetration limiting dome shaped PDC surface is fixedly positioned immediately trailing the primary PDC cutting disc to act as a shock absorber for the cutter disc. This smooth convex shaped diamond surface absorbs most of the impact loads to reduce PDC cutter breakage while drilling in a borehole.

Another advantage of the present invention over the prior art is that the very smooth hard diamond shock absorber dome surface, generates very little heat as it contacts the rock formation while drilling due to its extremely low coefficient of friction.

Still another advantage of the present invention is the ability of the convex diamond layer to dissipate heat very rapidly that may be generated by the friction of the diamond surface bearing on the rock because of the very high coefficient of thermal conductivity of the diamond.

The above noted objects and advantages of the present invention will be more fully understood upon study of the following description in conjunction with the detailed drawings.

DESCRIPTION OF THE PREFERRED EMBODIMENTS AND THE BEST MODE FOR CARRYING OUT THE INVENTION

Figure 1:
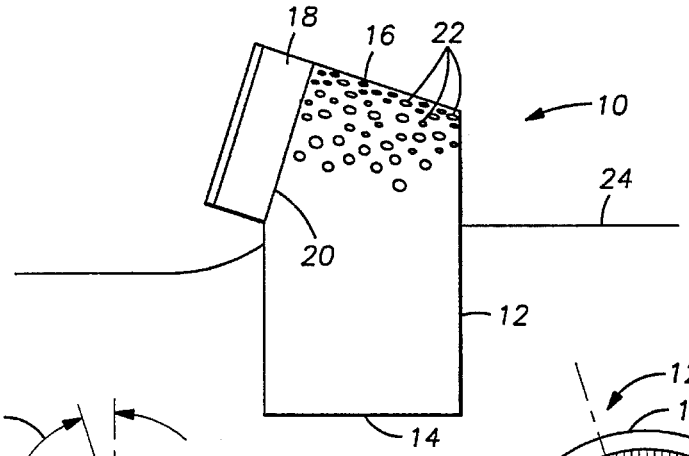
FIG. 1 (PRIOR ART)
FIG. 1 is a diagrammatic section through a prior art diamond cutting element, the cutter having diamond abrasion elements imbedded behind the diamond cutter disc.

Turning now to FIG. 1, a prior art diamond drag bit cutter generally designated as 10, consists of a tungsten carbide stud 12 having a base end 14 and a cutting end 16. The cutter base end 14 is fixedly attached to the bit drilling face 24. A polycrystalline diamond compact (PDC) cutter disc 18 is brazed to a rearwardly angled preformed flat 20 on the stud cutting end 16. The cutting end surface 16 is radiused to conform to the cylindrical surface of the PDC cutter disc 18. The cutting end 16 of carbide stud 12 is impregnated with small diamond crystals 22, which act as formation abrading elements when the PDC cutter 18 wears away and the diamond crystals 22 contact the rock being drilled. The drilling rate for these small diamond elements 22 is extremely slow as heretofore described.

Figure 2:
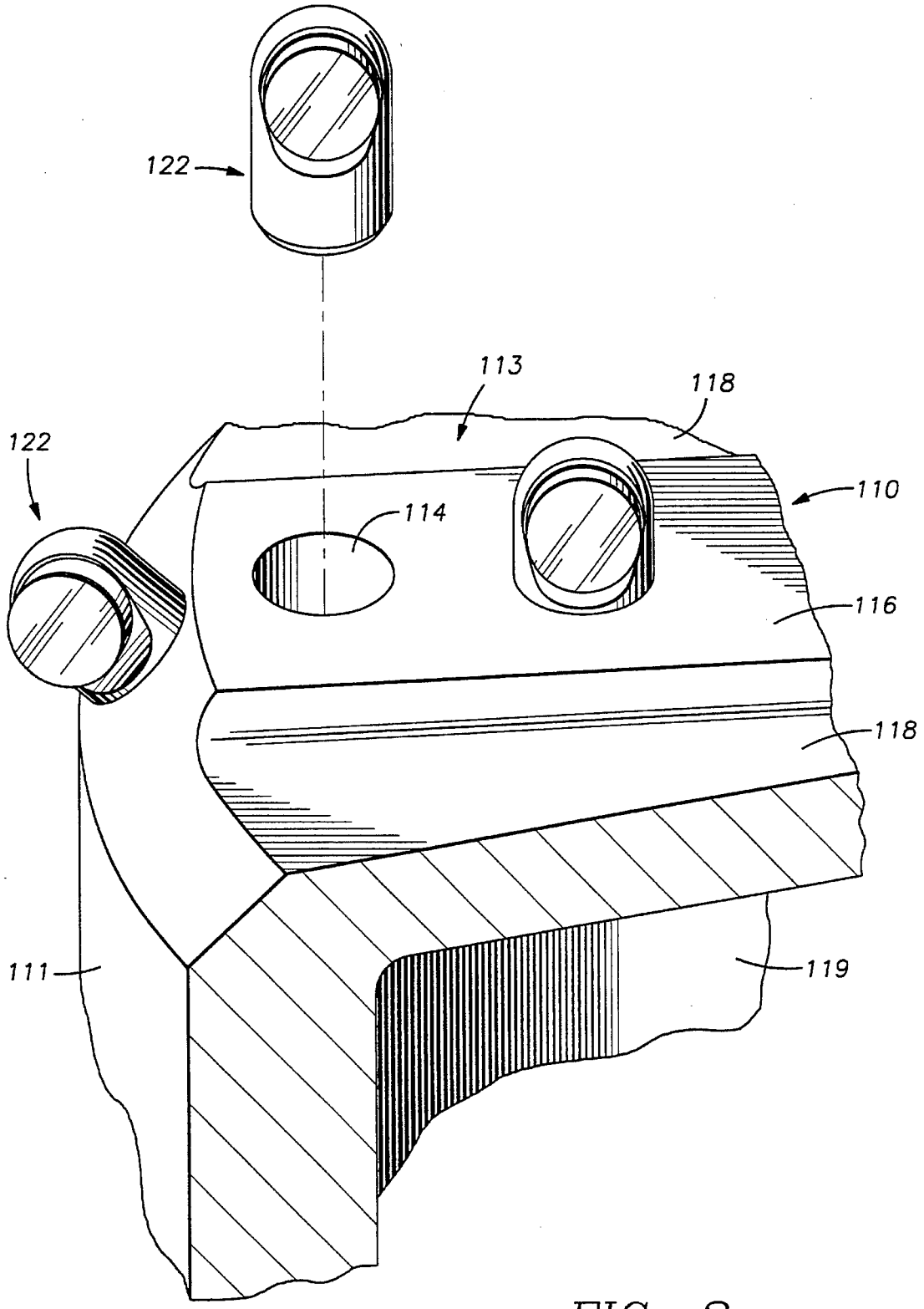
FIG. 2 is a fragmented perspective view partially in cross-section of a diamond drag bit incorporating polycrystalline diamond cutters of the present invention.

Turning now to FIG. 2, a fragmented perspective view of a diamond drag bit, generally designated as 110, illustrates a portion of a drag bit body 111. The bit body 111 forms a cutting end or head 113 that incorporates a plurality of polycrystalline diamond compact (PDC) cutters generally designated 122. The PDC cutters 122 are strategically disposed on the bit head 113 by brazing or press fitting into sockets 114 formed in raised lands or blades 116 formed by the head 113. The essentially radially disposed blades 116 form fluid channels 118 therebetween, which connect to a fluid plenum 119 formed in the bit head 113. Drilling fluid is transported under high pressure from the fluid plenum 119 to the fluid channels 118 by means of one or more fluid ports or nozzles (not shown) formed in the bit head 113 to clean and cool the PDC cutters 122.

Figure 3:
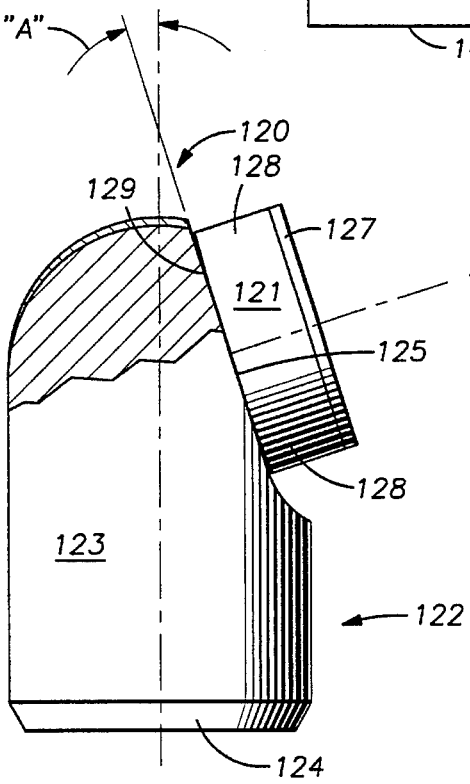
FIG. 3 is a partially cutaway side view of a diamond cutter of the present invention.

With reference now to FIG. 3, a polycrystalline diamond compact (PDC) cutter, generally designated as 122, illustrates the preferred embodiment of the present invention. The PDC cutter 122 is comprised of a tungsten carbide stud 123 having a base end 124 and a drilling end generally designated as 120. The drilling end 120 of stud 123 has a rearwardly formed flat surface 125 to which a polycrystalline diamond compact disc 121 is affixed by, for example, brazing. Diamond compact 121 is comprised of a polycrystalline diamond layer 127 bonded to a tungsten carbide substrate 128 under high pressure/high temperature (HP/HT) diamond synthesis conditions. The drilling end 120 of stud 123 has a polycrystalline diamond dome shaped layer 126 bonded to the tungsten carbide stud 123 under HP/HT conditions. The rearwardly positioned flat 125 on the carbide stud 123 is formed, for example, by using an EDM process to cut off a portion of the domed end 120 of carbide stud 123 at a rearwardly tilted angle "A" of between 5° and 30° with 20° being the preferred angle. Brazing the ground flat surface 129 of PDC cutter disc 121 to the ground fiat surface 125 of the carbide stud 123 orients the PDC cutter disc 121 in a negative rake attitude in relation to the rock face being drilled (see FIG. 5). The remaining dome shaped diamond layer 126 is the surface on the cutter 122 that functions as a shock absorber to lower the impact loads on the diamond cutting layer 127 of the diamond compact disc 121 when drilling hard fractured or laminated hard and soft rock formations (130 FIG. 5).

Although diamond cutting layer 127 of cutter 121 is shown as a planar face, which is the preferred embodiment, layer 127 may be a curved surface, for example, convex for certain drilling applications.

Figure 4:
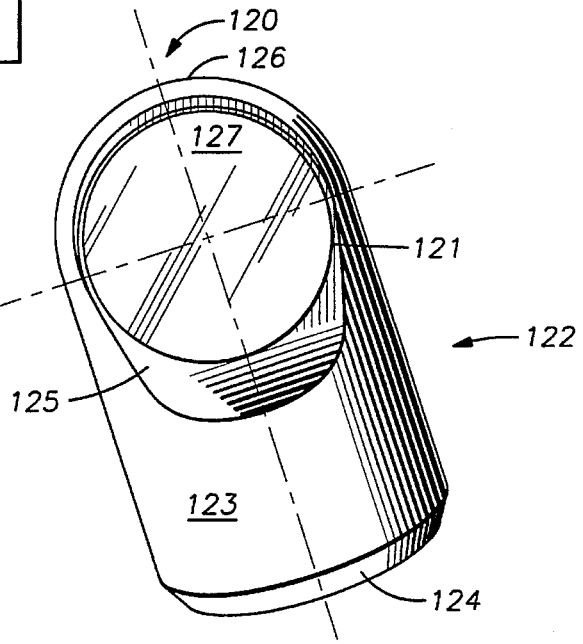
FIG. 4 is a front view of the cutter of FIG. 3 illustrating the position of the diamond disc mounted to a flat portion formed on the stud.

Referring to FIG. 4, a front view of FIG. 3 shows the PDC cutter 122 having a tungsten carbide stud 123 with a base end 124 and a drilling end generally designated 120. A PDC cutter disc, generally designated as 121, is shown affixed to surface 125 formed on carbide stud 123. The dome shaped diamond layer 126 is shown behind the PDC cutter disc 121 and the polycrystalline diamond layer 127 bonded to the carbide substrate 128 of disc 121.

Figure 5:
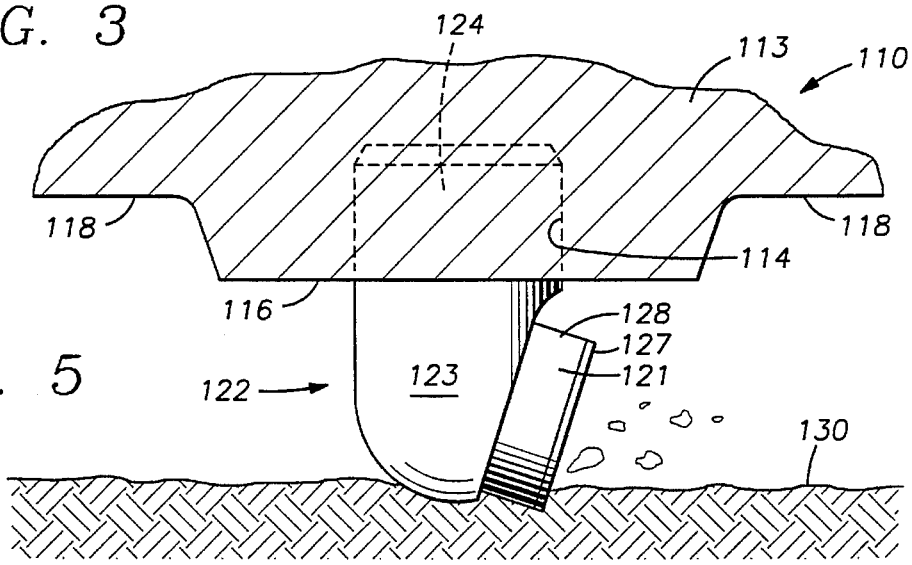
FIG. 5 is a partial section of a diamond drag bit with a cutter positioned in a blade of the bit and its relative position to the rock formation being drilled.

Turning now to FIG. 5, the preferred PDC type cutter 122 is shown mounted in a drilling attitude on a blade 116 formed by diamond drag bit head 113. The cutter 122 is rigidly affixed to the blade 116 by press fitting or brazing the base end 124 of the carbide stud 123 into a socket 114 formed in the blade 116. The diamond face 127 of the cutter disc 121 has a negative back rake angle with respect to the rock formation 130 being drilled. The fluid channels 118 formed by the blades 116 furnish the drilling fluid across the cutters 122 to keep them clean and cool. The dome shaped diamond layer 126 is shown in contact with the rock face 130 preventing the diamond cutting edge of PDC cutter 127 from penetrating the rock 130 any deeper and absorbing a major portion of the impact forces created while drilling non-homogeneous rock 130. The absorption of the impact forces by the dome shaped diamond 126 minimizes the breakage of the diamond layer 127 of cutter disc 121, thereby allowing the bit 110 to drill rock formations 130 that standard PDC cutters cannot economically drill. The dome shaped diamond layer 126 has a very smooth surface and diamond also has the lowest coefficient of friction of any material, therefore minimal heat is generated as it contacts the rock face 130. Diamond also has the highest coefficient of thermal conductivity whereby any detrimental heat that may be generated by the diamond layer 126 rubbing the rock face 130 is very rapidly dissipated thereby maintaining the physical properties of the diamond layer 126 to a useful life span.

It is well to note that a complete unitary cutter 122 may be made using tape casting techniques, thereby eliminating the brazing of the wafer surface 129 to stud surface 125.

It should be understood that the compact cutting layer 127 (FIG. 3) of compact 121 (FIG. 3) and the dome shaped penetration layer 126 (FIG. 3) of carbide stud 123 (FIG. 3) may be formed from ultra hard materials other than polycrystalline diamond. For example, cubic boron nitride (cBN), may be utilized without departing from the spirit and intent of the present invention.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A drag bit having a multiplicity of stud type diamond inserts strategically positioned on a cutting face formed by a body of said drag bit, said inserts comprising;

a cylindrical stud body forming a first base end and a second cutting end, said cutting end consisting of a substantially spherical dome surface, said dome surface further forming a relatively flat surface that is positioned below an apex of said dome, said flat surface being angled rearwardly at a negative rake angle from an axis of the stud body, and a polycrystalline compact connected to said flat surface, a cutting edge formed by said compact nearest said apex of said dome is positioned below said apex such that the dome limits penetration of the cutting edge when the diamond insert is in a working position as said drag bit works in an earthen formation.

2. The invention as set forth in claim 1 wherein said stud body consists of cemented tungsten carbide.

3. The invention as set forth in claim 1 wherein the dome of said stud is a layer of polycrystalline diamond.

4. The invention as set forth in claim 1 wherein the dome of said stud is a layer of cubic boron nitride.

5. The invention as set forth in claim 1 wherein the polycrystalline compact is diamond.

6. The invention as set forth in claim 1 wherein the polycrystalline compact is cubic boron nitride.

7. The invention as set forth in claim 1 wherein the polycrystalline compact is metalurgically bonded to said flat surface,

8. The invention as set forth in claim 6 wherein said compact is brazed to said flat surface.

9. The invention as set forth in claim 1 wherein the negative rake angle with respect to said axis of said stud body is from 5 to 30 degrees.

10. The invention as set forth in claim 9 wherein the negative rake angle is 20 degrees.

11. A stud type cutter comprising;

a cylindrical stud body forming a first base end and a second cutting end, said cutting end consisting of a substantially spherical dome surface, said dome surface further forming a relatively flat surface that is positioned below an apex of said dome, said flat surface being angled rearwardly at a negative rake angle from an axis of the stud body, and a polycrystalline compact connected to said flat surface, a cutting edge formed by said compact nearest said apex of said dome is positioned below said apex such that the dome limits penetration of the cutting edge when the stud cutter is in a working position as said cutter works against a workpiece.

12. The invention as set forth in claim 11 wherein said stud body is cemented carbide.

13. The invention as set forth in claim 11 wherein the dome of said stud is a polycrystalline diamond layer.

14. The invention as set forth in claim 11 wherein the polycrystalline compact is diamond.

15. The invention as set forth in claim 11 wherein the compact is brazed to the flat surface.

16. The invention as set forth in claim 11 wherein the negative rake angle with respect to said axis of said stud body is from 5 to 30 degrees.

17. The invention as set forth in claim 16 wherein the negative rake angle is 20 degrees.

* * * * *